US005620270A

United States Patent [19]

Gueret

[11] Patent Number: 5,620,270

[45] Date of Patent: Apr. 15, 1997

[54] DEVICE FOR STORING AND APPLYING A MAKEUP PRODUCT

[75] Inventor: Jean-Louis Gueret, Paris, France

[73] Assignee: L'Oreal, Paris, France

[21] Appl. No.: 523,546

[22] Filed: Sep. 5, 1995

[30] Foreign Application Priority Data

Sep. 5, 1994 [FR] France ..... 94 10609

[51] Int. Cl.[6] ..... A45D 40/24; A45D 40/00

[52] U.S. Cl. ..... 401/126; 401/17; 401/18; 401/24; 401/119; 401/129; 132/218

[58] Field of Search ..... 401/17, 18, 24, 401/119, 122, 126, 129; 132/218

[56] References Cited

U.S. PATENT DOCUMENTS

| | | |
|---|---|---|
| 1,478,026 | 12/1923 | Dalzell . |
| 2,964,045 | 12/1960 | Otto et al. . |
| 3,103,032 | 9/1963 | Brenne . |

FOREIGN PATENT DOCUMENTS

| | | | |
|---|---|---|---|
| 365273 | 4/1990 | European Pat. Off. . | |
| 1092052 | 4/1955 | France . | |
| 3240152 | 5/1984 | Germany . | |
| 600748 | 4/1948 | United Kingdom | 401/126 |
| WO91/19573 | 12/1991 | WIPO . | |

*Primary Examiner*—Steven A. Bratlie
*Attorney, Agent, or Firm*—Oliff & Berridge

[57] ABSTRACT

A device for storage and application of a makeup product includes a container and two applicators each including a rod provided at one end with an application element for the makeup product and attached at its other end to a gripping element in the form of a cap. The rod of a first applicator is hollow over at least a portion of its length and defines an axial hollow in which the application element and the rod of second applicator are accommodated. The wall of the rod of the first applicator comprises at least one slot permitting communication between its axial hollow and the internal volume of the container. The gripping element, in the form of a cap, of the second applicator is connected in a removable fashion with the gripping element, in the form of a cap, of the first applicator.

19 Claims, 2 Drawing Sheets

DEVICE FOR STORING AND APPLYING A MAKEUP PRODUCT

BACKGROUND OF THE INVENTION

1. Object of the Invention

The present invention relates to a device for storing and applying a makeup product.

2. Discussion of Related Art

Numerous types of devices for storing and applying a makeup product are known, comprising a container for the makeup product and an applicator capable of being stored in said container. Typically, these known devices comprise an elongated rod provided at one end with an element for applying the makeup product and integral at its other end with a gripping element that simultaneously constitutes a cap capable of closing the opening of the container in which the applicator is fitted.

Devices are also known composed of two applicators comprising application elements with different characteristics, capable of being withdrawn successively from said body of the device for selectively applying a quantity of makeup product contained therein, depending on different application conditions determined by the characteristics of the application element of each applicator.

In particular, such devices are known for the storage and application of mascara in which the application elements of each applicator are composed of eyelash brushes, with two brushes of different dimensions each being mounted at one end of a rod attached to a gripping element made in the form of a cap that can close an opening of the mascara container.

Various configurations of the container for such devices have been envisaged. For example, for the application of mascara, an elongated shape is used in which the applicators are mounted "head to tail," at two opposite ends of the body (EP-A-0 365 273) or in the form of a bottle provided with two openings in its upper part, in which openings the applicators are fitted and attached (DE-A-3 240 152). One of the applicators generally comprises a larger brush designed for long eyelashes and the other a smaller brush designed for short eyelashes. In all of these configurations it is necessary to provide the containers with two openings, with shapes and/or dimensions different from those to which users are accustomed, especially cylindrical elongated shapes with a length much greater than that of traditional devices. Moreover, it is not possible to use the two applicators in succession without at least one of the openings in the container remaining open, risking drying or premature degradation of the product inside.

The present invention proposes to provide a device for the storage and application of a makeup product using two applicators with different configurations, which in particular do not suffer from the shortcomings mentioned above and which can be produced without significant modification of the external appearance of the traditional devices.

The device according to the present invention is characterized by the rod of a first applicator being hollow over at least a portion of its length and defining an axial hollow in which the application element and the rod of the second applicator are accommodated, with the gripping element in the form of the cap of the second applicator being removably connected to the gripping element in the form of the cap of the first applicator.

To permit impregnation of the application element of the second applicator by the product contained in the container, the wall of the rod of the first applicator has at least one slot allowing its axial hollow and the internal volume of the container to communicate. Preferably, the slot or slots are made at the level of the application element of the second applicator when it is in the position in which it is fitted into the first applicator.

The application elements of the two applicators of the device according to the invention can be of the same type or of different types.

Depending on the makeup product to be applied, brushes can be used, especially eyelash brushes, tweezers, or ferrules that are made of foam or felt, for example flocked plastic material, or are porous, fritted for example.

In one particular embodiment, the rod of the second applicator is likewise hollow over at least a portion of its length and comprises at its upper part a reservoir capable of holding in particular a product different from the makeup product contained in the container, said different product being for example a moistening or diluting product for the makeup product in the container, or a different makeup product, before being applied separately by the second applicator.

BRIEF DESCRIPTION OF THE DRAWINGS

In order to make it easier to understand the invention, embodiments will now be described which are nonlimiting and refer to the attached diagrams wherein.

DETAILED DESCRIPTION OF PREFERRED EMBODIMENTS

Figure 1:
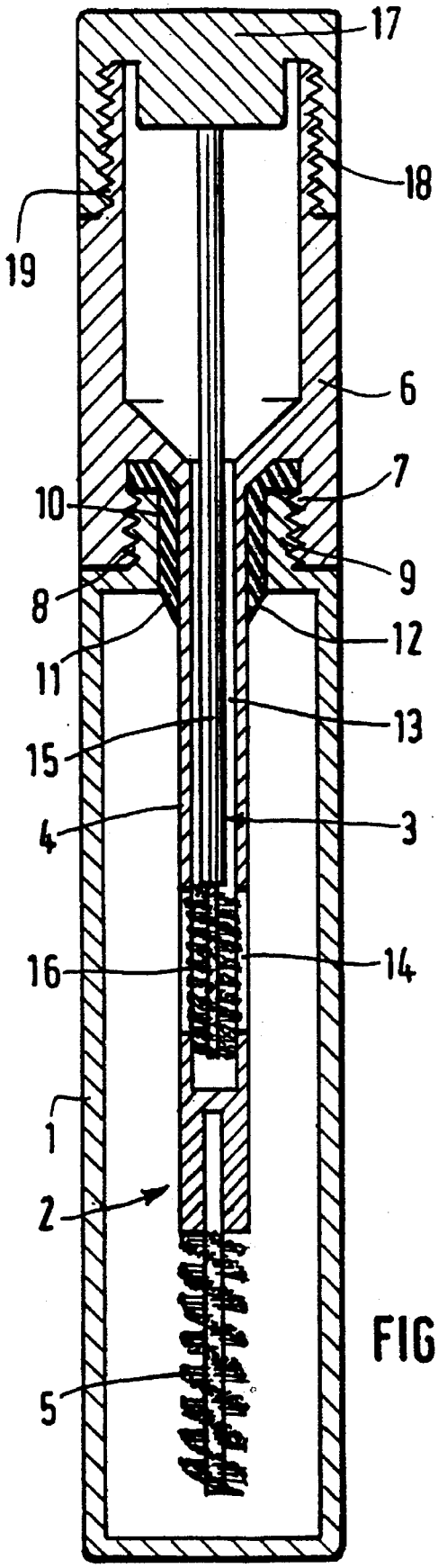
FIG. 1 shows a longitudinal section of one embodiment of the device according to the invention.
Figure 2:
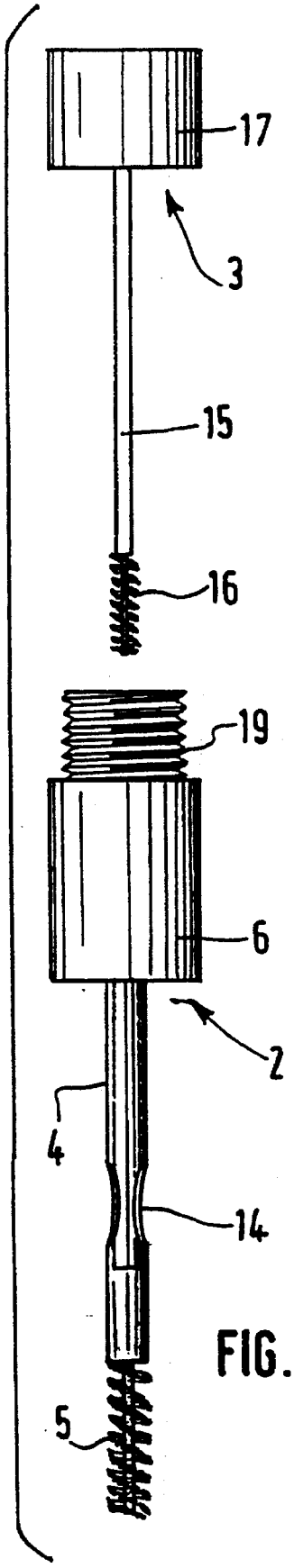
FIG. 2 shows the two applicators of the device of FIG. 1 in the separated position for use.
Figure 3:
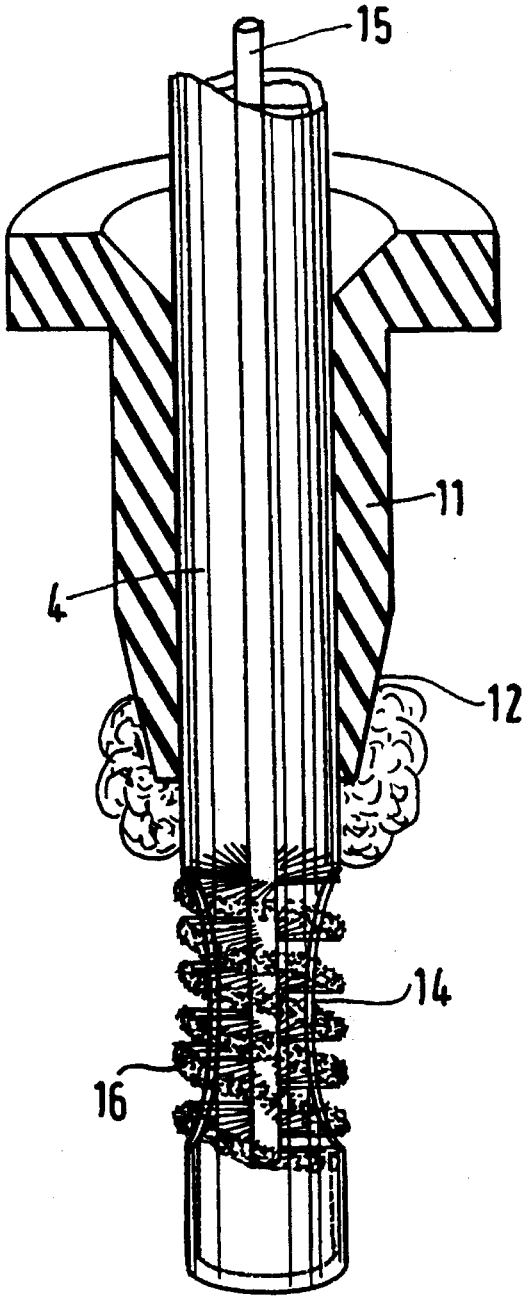
FIG. 3 is a schematic cutaway view of a portion of the device of FIG. 1 during one stage of its use.

Reference will first be made to FIGS. 1 to 3 which show a device for storage and application of mascara, made according to the invention.

The device comprises an elongated tubular container I and two applicators, generally designated by 2 and 3 respectively.

Applicator 2 comprises a rod 4 at the lower end of which an applicator element, for example an eyelash brush 5, is mounted. Rod 4 is integral at its other end with an element 6 intended to serve simultaneously as a gripping element for applicator 2 and for sealing container 1. The gripping element is in the form of a cap 6 having at its lower end an internal thread 7 which can cooperate with an external thread 8 on a portion of the upper neck 9 of container I delimiting opening 10 thereon.

In conventional fashion, at the level of neck 9, a ferrule 11 is provided comprising at its lower end a truncated portion 12 designed, as is known of itself, for "wringing dry" brush 5 impregnated with mascara, or other makeup product, during the extraction motion of first applicator 2.

The rod 4 of first applicator 2 is hollow over a portion of its length and has an axial hollow 13 communicating by slots 14 provided in the wall of rod 4 with the inside volume of container 2.

The second applicator 3 comprises a rod 15 provided at its lower part with an applicator element, for example an eyelash brush 16, of smaller diameter and shorter length than brush 5 of first applicator 2. Rod 15 is integral at its upper part with a cap 17 comprising an internal thread 18 for screwing cap 17 on an external thread 19 provided on the upper end of cap 6 of first applicator 2.

Rod 15 and brush 16 of second applicator 3 are dimensioned so as to be able to fit into axial opening 13 of rod 4 of the first applicator, with the length of rod 15 being such that in the position shown in FIG. 1 in which second applicator 3 is fitted into first applicator 2 and integrated therewith by screwing at the respective caps. Brush 16 of the second applicator is essentially at the level of slots 14 of the rod of the first applicator.

Thus, as shown in FIG. 3, when the assembly constituted by the two applicators is released from the container, the zone of rod 4 of the first applicator in which slots 14 and brush 16 of the second applicator are located passes through wringing opening 12, the mascara that is located at the level of the wringing opening is applied to brush 16 through slots 14.

In this manner, brush 16 is loaded with mascara, which can then be applied by the user by pulling the second applicator out of the first applicator as suggested in FIG. 2. The first applicator can be returned to the container while the second applicator is in use.

Of course the assembly of the two applicators relative to one another and relative to the container is not necessarily accomplished by screwing as shown, and other known means of assembly, especially by snapping, can be provided without departing from the scope of the invention.

Similarly, the invention is not limited in any way, as regards the application element of each applicator, to the structure of the eyebrow brush shown.

Figure 4:
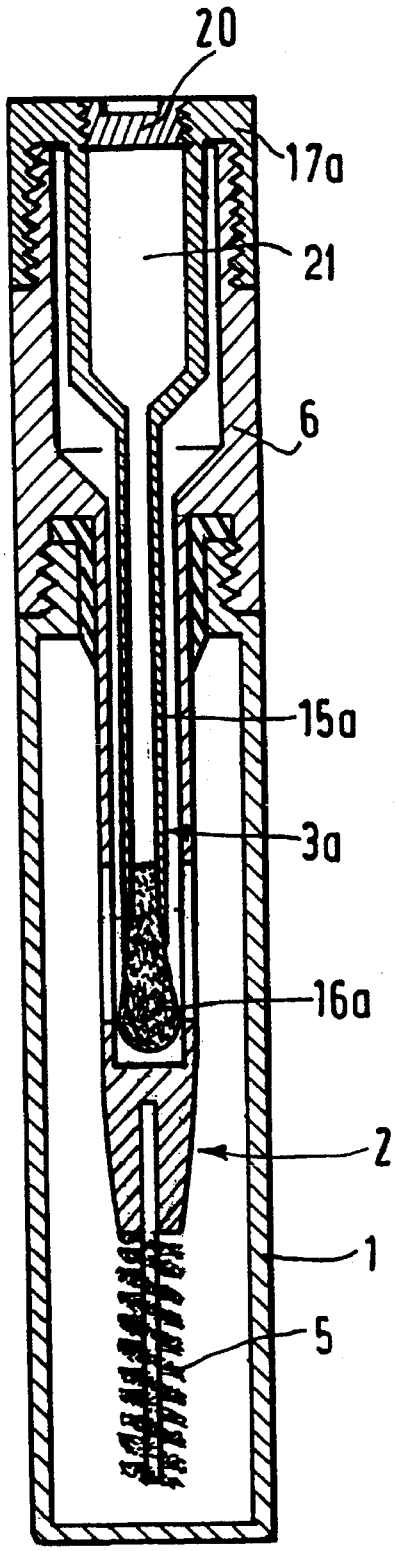
FIG. 4 shows a longitudinal section of a variation on the device according to the invention.

In the embodiment shown in FIG. 4, container 1 and first applicator 2 have essentially the same structure as in the first embodiment shown in FIGS. 1 to 3.

The principal difference lies in the fact that second applicator 3*a* has a hollow rod 15*a* that communicates with a reservoir 21 provided in its upper part and is closed by a stopper 20 provided in cap 17*a*.

The application element of the second applicator is not made in the form of a brush but in the form of a felt member 16*a* supplied by capillary action from reservoir 21 through hollow rod 15*a*.

Although the invention has been described in conjunction with specific embodiments, it is obvious that it is in no way limited to them and that variations and modifications can be made without departing from either its scope or its spirit.

What is claimed is:

1. A device for storage and application of a makeup product comprising:

a container having an internal volume in which the makeup product is stored;

a first applicator removably coupled to the container including a first rod having two ends, one end having a first application element for applying the makeup product and the other end having a first gripping element, wherein the first rod is hollow over at least a portion of its length defining an axial hollow therein and has at least one slot therein allowing communication between its axial hollow and the internal volume of container; and a second applicator including a second rod with two ends, one end having a second application element for applying the makeup product and the other end having a second gripping element, wherein the second application element and the second rod of the second applicator are accommodated in the axial hollow of the first rod and the second gripping element of the second applicator is removably connected to the first gripping element of the first applicator.

2. The device of claim 1, wherein the at least one slot is generally aligned with the second application element of the second applicator in the position in which it is fitted into the axial hollow of the first applicator.

3. The device of claim 2, wherein the second rod of the second applicator is hollow over at least a portion of its length and comprises in an upper part thereof a reservoir that communicates with the second application element of the second applicator through the hollow portion of the second rod.

4. The device of claim 1, wherein the second rod of the second applicator is hollow over at least a portion of its length and comprises in an upper part thereof a reservoir that communicates with the second application element of the second applicator through the hollow portion of the second rod.

5. The device of claim 4, wherein the second gripping element has a removable stopper therein that provides access to the reservoir.

6. The device of claim 4, wherein the first application element is a brush and the second application element is a felt member.

7. The device of claim 1, wherein at least one of the first and second application elements is an eyelash brush for the storage and application of mascara.

8. The device of claim 1, wherein the gripping element of both the first and second applicators is a sealing cap.

9. The device of claim 1, wherein the first applicator is threadedly engaged on the container and the second applicator is threadedly engaged on the first applicator.

10. The device of claim 1, wherein first gripping element has internal threads on a lower portion thereof that engage the container and external threads on an upper portion thereof that engage the second applicator.

11. The device of claim 1, further comprising a ferrule coupled to the container surrounding both the first and second applicators when inserted into the container that scrapes excess makeup product from the first and second application elements when they are removed from the container.

12. An application and storage assembly for use with makeup comprising:

an elongated tubular container having an opening for storing makeup therein;

a first applicator removably coupled to the container having a first hollow rod with two ends, one end with a first application element that is stored within the container and the other end with a first cap thereon extending from the container during storage, the first hollow rod having at least one slot therein positioned along its length; and a second applicator removably coupled to the container having a second rod with two ends, one end with a second application element that is stored within the first hollow rod inside the container and is configured to be in communication with makeup stored in the container, and the other end with a second cap thereon extending from the container during storage and sealing the opening to the container.

13. The assembly of claim 12, wherein the at least one slot is aligned with the second application element during storage.

14. The assembly of claim 12, wherein the second cap is removably secured to the first cap to seal the container.

15. The assembly of claim 12, wherein at least one of the first and second application elements is a brush for applying mascara.

16. The assembly of claim 12, wherein the first and second application elements are brushes for applying mascara.

17. The assembly of claim 12, wherein the second applicator has a storage reservoir therein for storing additional makeup, wherein the second rod is hollow and the second application element is in communication with the storage reservoir.

18. An application device comprising:

a first applicator including a first rod having two ends, one end having a first application element and the other end having a first gripping element, wherein the first rod is hollow over at least a portion of its length defining an axial hollow therein and has at least one through slot therein; and a second applicator including a second rod with two ends, one end having a second application element and the other end having a second gripping element, wherein the second application element and the second rod of the second applicator are accommodated in the axial hollow of the first rod such that the at least one slot in the first rod is generally aligned with the second application element of the second applicator and the second gripping element of the second applicator is removably connected to the first gripping element of the first applicator.

19. The application device of claim 18, wherein the second applicator has a reservoir formed therein and the second rod is hollow, the reservoir and the second application element being in communication via the hollow second rod.

* * * * *